US007200871B1

(12) United States Patent
Carlson

(10) Patent No.: US 7,200,871 B1
(45) Date of Patent: Apr. 10, 2007

(54) FABRIC FOR LOAD BEARING VESTS HAVING A POCKET FASTENING SYSTEM

(75) Inventor: Richard A. Carlson, Chino Hills, CA (US)

(73) Assignee: Safari Land Ltd., Inc., Ontario, CA (US)

( * ) Notice: Subject to any disclaimer, the term of this patent is extended or adjusted under 35 U.S.C. 154(b) by 53 days.

(21) Appl. No.: 11/245,902

(22) Filed: Oct. 7, 2005

(51) Int. Cl.
*F41H 1/02* (2006.01)
*A41D 27/20* (2006.01)
*A41D 1/04* (2006.01)
*A41D 27/04* (2006.01)

(52) U.S. Cl. ..... 2/103; 2/2.5; 2/102; 2/97; 2/253; 2/249; 24/468; 24/306

(58) Field of Classification Search ..... 2/249, 2/253, 2.5, 462, 266, 265, 97, 100, 102, 103, 2/321, 247, 248; 24/3.1, 3.5, 72.7
See application file for complete search history.

(56) References Cited

U.S. PATENT DOCUMENTS 3,557,384 A * 1/1971 Barron et al. ..... 2/2.5
3,611,444 A * 10/1971 Rector ..... 2/227
4,507,802 A * 4/1985 Small ..... 2/2.5
4,535,478 A * 8/1985 Zufle ..... 2/2.5
5,014,359 A * 5/1991 Hanson ..... 2/94
5,063,614 A * 11/1991 McSheffery ..... 2/94
5,379,491 A * 1/1995 Solo ..... 24/3.3
5,433,359 A * 7/1995 Flowers ..... 224/222
5,526,535 A * 6/1996 Dobrzenski ..... 2/102
5,657,516 A * 8/1997 Berg et al. ..... 24/452
5,724,707 A * 3/1998 Kirk et al. ..... 24/3.7
5,839,167 A * 11/1998 Wagner ..... 24/3.7
5,946,732 A * 9/1999 Richards ..... 2/247
6,029,270 A * 2/2000 Ost et al. ..... 2/2.5
6,131,198 A * 10/2000 Westrick ..... 2/102
6,279,804 B1 * 8/2001 Gregg ..... 224/675
6,357,084 B1 * 3/2002 Haidon ..... 24/3.12
6,511,357 B1 * 1/2003 Williams et al. ..... 441/106
6,669,608 B1 * 12/2003 Winston ..... 482/105
2002/0067955 A1 * 6/2002 Carmichael ..... 405/186
2004/0187183 A1 * 9/2004 Hautala ..... 2/24
2005/0076422 A1 * 4/2005 Aldridge et al. ..... 2/455
2005/0120464 A1 * 6/2005 Clark ..... 2/247
2005/0188450 A1 * 9/2005 Clark ..... 2/247
2006/0096009 A1 * 5/2006 Carlson ..... 2/247

* cited by examiner

*Primary Examiner*—Robert H Muromoto
(74) *Attorney, Agent, or Firm*—Christie, Parker & Hale, LLP.

(57) ABSTRACT

A loop fabric sheet for a load bearing vest having a rotary die cut pattern including an array of holes extending through the sheet for receipt of snaps to interface with a Snap Grid removable pocket and an array of slots extending through the fabric sheet to accommodate straps for a Molle system removable pocket.

20 Claims, 2 Drawing Sheets

SECTION A-A
12
24
20
22
20
10
14

12
18
18
18
A
A
16
16
16
20
20
20
20
2"
2"
1/4"
1 1/4"
1"
1/8"

FABRIC FOR LOAD BEARING VESTS HAVING A POCKET FASTENING SYSTEM

BACKGROUND OF THE INVENTION

The present invention relates generally to fabric for a load bearing vest having a fastener for attaching objects, and, more particularly, to a fabric fastening system that securely mounts removable pockets to an outer surface of a vest. It is well recognized that certain types of modular load bearing vests and backpacks with modular pockets employ some type of fastening system to hang the removable pockets on the exterior of the vest. In particular applications such as military, law enforcement, or sporting applications, there is a need to be able to position necessary pockets or other such objects where they are most useful to the individual user, as well as providing their ability to be moved to a different position as necessary for different applications.

Examples of types of fastening systems used to removably attach pockets to a garment include the use of hook and loop fasteners, keepers with slides, buttons, snap fasteners, and soft snap devices. Generally, the most common removable pocket fastening systems, particularly for use with ballistic vests and tactical gear, are the Molle and Snap Grid systems. The Snap Grid system uses a plurality of snaps formed on a hook fabric on the pocket which mates with posts positioned on a loop fabric on the vest. A removable pocket allows the user to tailor their garment to best fit their needs, replace worn out pockets, or exchange pockets more suitable for a particular application.

The Molle system for attaching a removable pocket to a garment includes the use of a flexible, yet somewhat rigid strap being attached to the pocket and threaded or interwoven between a plurality of horizontal webbings sewn onto the outer surface of the vest. A problem associated with this technique is the difficulty and time consuming nature of sewing a plurality of webbings on the vest to receive the straps to secure the pocket to the garment. Consequently, a need exists for an improved fabric for a fastening system to attach removable pockets to the outer surface of a garment which is easy and inexpensive to manufacture and reliable for multiple applications.

SUMMARY OF THE INVENTION

The fabric for a load bearing vest having a fastening system for removable pockets of the present invention overcomes the problems associated with previous fabric and is inexpensive to manufacture. The fabric is a loop sheet (of the hook and loop fastening variety) constructed with a rotary die cut pattern designed to interface with the Molle and Snap Grid pouch attachment systems. The loop fabric is hook compatible and the rotary die cut pattern is a series of slots and holes that are spaced to accommodate both pocket attachment platforms. Metallic snaps having a post and a stud can easily be placed into the pilot holes to create the proper system to accept the standard snap matrix pouches. The fabric includes a matrix of ⅛" pilot holes spaced in a 2"×2" matrix for the Snap Grid fastening system, and a series of 1¼"×⅛" slots spaced apart 1½" horizontally and 1" vertically which is designed to accept the web weave straps of the Molle fastening system.

An advantage of the fabric of the present invention is a substantial labor savings in the production process as it eliminates cutting webbing to be positioned and bar tacked at 1½" intervals to create loops for the straps for the Molle system. The fabric is load bearing and can be cut to size and ready to accept the fastening system pouches as cut. The positions of the pilot holes for the snap grid are pre-indexed so that only the pressing on of the snaps needs to be completed. The resulting fabric can be fabricated into simple load bearing vests or added to more complex armor systems.

For a better understanding of the present invention, together with other features and components, reference is made to the following description taken in conjunction with the accompanying drawings.

DETAILED DESCRIPTION OF THE INVENTION

Figures 1, 2:
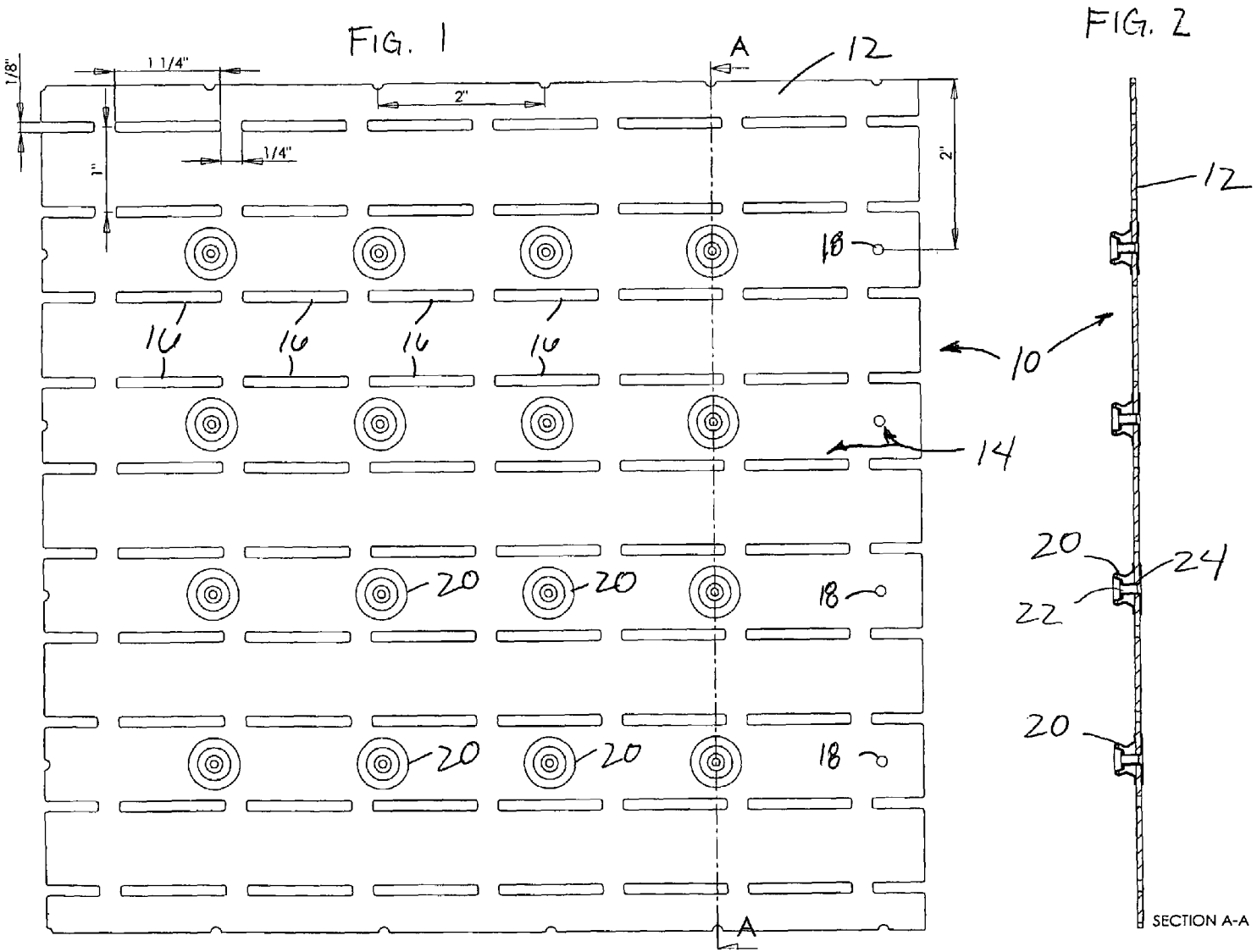
FIG. 1 is a top view of a fabric of the present invention.
FIG. 2 is a cross sectional view of FIG. 1 taken along line A—A.

The fabric 10 of the present invention is shown in FIGS. 1 and 2. The fabric is a loop sheet 12 which is hook compatible and contains a rotary die cut pattern 14 to provide an interface with the snap grid and Molle pouch attachment systems commonly used for a load bearing vest. The rotary die cut pattern includes a series of slots 16 and pilot holes 18 that are spaced to accommodate both the Snap Grid and Molle pocket platforms.

Preferably, the pilot holes 18 are ⅛" in diameter and are spaced on a 2"×2" matrix across the fabric sheet 12. Metallic snaps 20 having a post 22 and a stud 24 are secured in the pilot holes to create the proper system to accept the Snap Grid pouches.

The slots 16 are positioned in an array across the fabric sheet 12 and preferably are a series of 1¼" wide×⅛" tall slots which are spaced 1½" horizontally and 1" vertically apart. The array of slots creates a pattern designed to accept the Molle system pouches. Typically the fabric sheet would be rotary die cut onto a roll having the slot and pilot hole pattern so that the fabric can be cut to size according to the specific application. The positions of the pilot holes 18 for the Snap Grid are pre-indexed.

Figure 4:
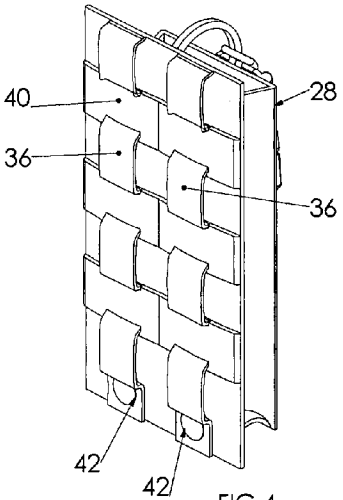
FIG. 4 is a back view of a Molle system pocket.
Figure 3:
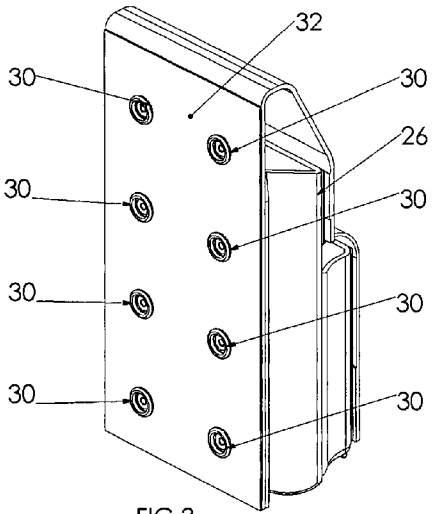
FIG. 3 is a back view of a Snap Grid pocket.
Figure 5:
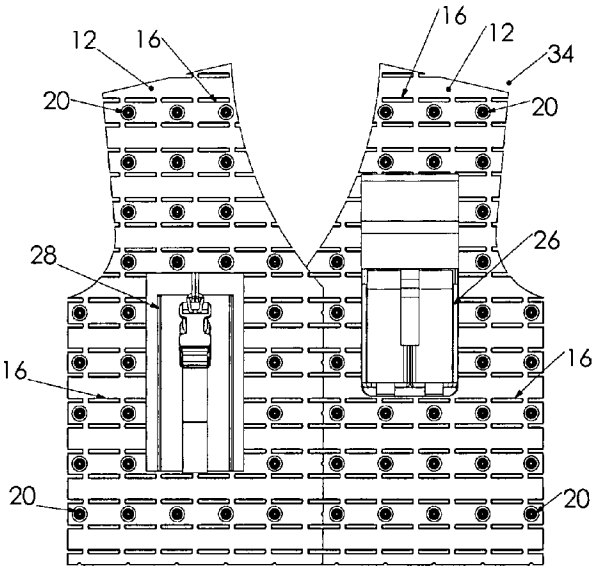
FIG. 5 is a front view of the fabric of FIG. 1 incorporated into a ballistic vest.

Referring to FIGS. 3, 4 and 5, the Snap Grid pouch 26 and the Molle system pouch 28 are illustrated. The Snap Grid pouch includes a female snap 30 positioned in each corner of the backface 32 of the pouch. As previously indicated, the snap posts are positioned in the pre-indexed pilot holes so that the pouch 26 can be attached to the fabric sheet 12 of a load bearing vest 34. Backface 32 of the Snap Grid pouch is a hook fabric which also assists in securing the pocket on the fabric sheet 12. Load bearing vest 34, for example can be a ballistic vest.

With respect to the Molle system pouch 28, the pouch includes straps 36 sewn along the top edge 38 of backface 40. Straps 36 have a free end 42 opposite of their attachment point along edge 38. The Molle system pouch is then attached to the loop sheet 12 by threading or weaving the free end 42 of the straps 36 through slots 16 on the vest. The straps are interleaved in and out of the slots and the backface 40 also is a hook material which assists in securing the pouch to the fabric sheet.

Although the present invention has been described and illustrated with respect to a fabric sheet for a pocket attachment system for a vest, it should be understood that the present invention is applicable for other types of containers or attachments for various garments or wearing apparel, such as shirts, jackets, pants, backpacks, or boots. In addition, although this invention has been described with reference to a particular embodiment, it is to be understood that the invention is not to be so limited and is capable of further and other embodiments within the scope of the claims appended hereto.

What is claimed is:

1. A hook compatible fabric sheet having a first array of holes through the fabric sheet spaced in a matrix to accommodate a removable pocket and a second array of slots through the fabric sheet spaced in a matrix to accommodate a second removable pocket.

2. The fabric sheet of claim 1 wherein the first array of holes and the second array of slots are formed by a rotary die cut operation.

3. The fabric sheet of claim 1 wherein the first array of holes are spaced vertically and horizontally in a 2" matrix.

4. The fabric sheet of claim 3 wherein a post of a snap is positioned in each hole in the array.

5. The fabric sheet of claim 1 wherein the fabric sheet is a loop material.

6. A carrier for a vest comprising:

a loop fabric sheet having a plurality of holes extending through the loop fabric sheet in a first grid array and a plurality of slots extending through the loop fabric sheet in a second grid array a fastener positioned in each hole in the first grid array on the loop fabric sheet and at least one removable pocket for attachment to at least one of the fasteners positioned in each hole or the slots extending through the loop fabric sheet.

7. The carrier of claim 6 wherein the removable pocket having a plurality of fasteners for mating with the fasteners on the fabric sheet of the carrier.

8. The carrier of claim 7 wherein the fasteners are snaps.

9. The carrier of claim 6 further comprising a second removable pocket having at least one strap attached to the second removable pocket which is threaded through a portion of the slots in the loop fabric sheet.

10. A ballistic vest comprising:

a front panel;

a back panel a fabric sheet positioned on an outer surface of at least one of the front panel or back panel, the fabric sheet having a grid array of holes extending through the sheet containing a fastener and the fabric sheet further having a second grid array of slots extending through the fabric sheet and at least one removable pocket for attachment to at least one of the fasteners positioned in each hole or the slots extending through the loop fabric sheet.

11. The ballistic vest of claim 10 wherein the removable pocket having a plurality of fasteners attached to the fasteners located in the grid array of holes on the fabric sheet.

12. The ballistic vest of claim 10 wherein the removable pocket having at least one strap threaded through a portion of the slots in the second grid array on the fabric sheet.

13. The ballistic vest of claim 10 wherein the fabric sheet is a hook compatible loop material.

14. The fabric sheet of claim 1 wherein the slots are spaced 1½" horizontally and 1" vertically.

15. The carrier of claim 6 wherein the slots are spaced 1½" horizontally and 1" vertically.

16. The ballistic vest of claim 10 wherein the slots are spaced 1½" horizontally and 1" vertically.

17. The carrier of claim 6 wherein the first grid array of holes is a 2"×2" matrix.

18. The ballistic vest of claim 10 wherein the grid array of holes is a 2"×2" matrix.

19. The carrier of claim 6 wherein the holes and the slots are rotary die cut.

20. The ballistic vest of claim 10 wherein the holes and the slots are rotary die cut.

* * * * *

UNITED STATES PATENT AND TRADEMARK OFFICE

CERTIFICATE OF CORRECTION

PATENT NO. : 7,200,871 B1
APPLICATION NO. : 11/245902
DATED : April 10, 2007
INVENTOR(S) : Carlson It is certified that error appears in the above-identified patent and that said Letters Patent is hereby corrected as shown below:

In the Claims

| | |
|---|---|
| Column 3, line 19, Claim 3 | Delete "are",<br>Insert --is-- |
| Column 3, line 28, Claim 6 | After "array",<br>Insert --;-- |
| Column 3, line 30, Claim 6 | After "sheet",<br>Insert --;-- |
| Column 3, line 35, Claim 7 | Delete "having",<br>Insert --has-- |
| Column 4, line 5, Claim 10 | After "panel",<br>Insert --;-- |
| Column 4, line 11, Claim 10 | After "sheet",<br>Insert --;-- |
| Column 4, line 15, Claim 11 | Delete "having",<br>Insert --has-- |
| Column 4, line 19, Claim 12 | Delete "having",<br>Insert --has-- |

Signed and Sealed this

Seventeenth Day of July, 2007

JON W. DUDAS
*Director of the United States Patent and Trademark Office*